US006115579A

United States Patent [19]

Taniguchi et al.

[11] Patent Number: 6,115,579

[45] Date of Patent: Sep. 5, 2000

[54] APPARATUS FOR REMOVING PRINT FROM A RECORDING MEDIUM

[75] Inventors: Kazuko Taniguchi, Takatsuki; Haruhiko Atarashi, Fujiidera, both of Japan

[73] Assignee: Minolta Co., Ltd., Osaka, Japan

[21] Appl. No.: 09/250,840

[22] Filed: Feb. 17, 1999

[30] Foreign Application Priority Data

Feb. 20, 1998 [JP] Japan ..... 10-038572

[51] Int. Cl.[7] ..... G03G 15/00

[52] U.S. Cl. ..... 399/411; 15/102; 162/4

[58] Field of Search ..... 399/1, 411; 271/303; 162/4; 156/344, 584, 230, 236, 241; 15/77, 102

[56] References Cited

U.S. PATENT DOCUMENTS

| | | | |
|---|---|---|---|
| 4,992,833 | 2/1991 | Derimiggio | 399/308 |
| 5,006,189 | 4/1991 | Tsukamoto et al. | 156/247 |
| 5,483,321 | 1/1996 | Cahill et al. | 156/230 X |
| 5,540,815 | 7/1996 | Igarashi et al. | 162/5 |
| 5,593,937 | 1/1997 | Saito et al. | 156/230 X |
| 5,632,856 | 5/1997 | Buie | 162/4 |
| 5,635,005 | 6/1997 | Saitoh et al. | 156/234 |
| 5,642,550 | 7/1997 | Maruyama et al. | 15/102 |
| 5,678,158 | 10/1997 | Kurotori et al. | 399/390 |
| 5,735,009 | 4/1998 | Saito et al. | 15/102 X |
| 5,855,734 | 1/1999 | Saito et al. | 156/584 |
| 5,896,612 | 4/1999 | Maruyama et al. | 15/102 |
| 5,897,726 | 4/1999 | Shinkai et al. | 156/230 X |

FOREIGN PATENT DOCUMENTS

| | | |
|---|---|---|
| 1-281483 | 11/1989 | Japan . |
| 1-297294 | 11/1989 | Japan . |
| 4-064472 | 2/1992 | Japan . |
| 5-216374 | 8/1993 | Japan . |
| 7-020754 | 1/1995 | Japan . |
| 7-175385 | 7/1995 | Japan . |

*Primary Examiner*—William J. Royer
*Attorney, Agent, or Firm*—Sidley & Austin

[57] ABSTRACT

An apparatus for removing printing material from a recording member on which an image is recorded by the printing material is provided with a releasing member and a separating device. The releasing member has a plane surface with which the surface of the recording member recorded with the printing material comes into contact. The releasing member moves to a predetermined direction with the recording member held thereon. The separating device is disposed on the plane surface of the releasing member for separating the recording member from the releasing member. A separation line between the releasing member and the recording member is angled with respect to the front end of the recording member.

16 Claims, 7 Drawing Sheets

APPARATUS FOR REMOVING PRINT FROM A RECORDING MEDIUM

This application is based on application No. 10-38572 filed in Japan, the contents of which is hereby incorporated by reference.

BACKGROUND OF THE INVENTION

The present invention relates to an apparatus for removing printing material on a recording member.

Conventionally, there has been proposed, from the viewpoint of paper recycling, an apparatus for removing printing material on a recording member recorded by an electrophotographic system. In the apparatus, a heat-melting releasing member is brought into contact with the recording member and heated. Then the releasing member is cooled and separated from the recording member, thereby the printing material on the recording member is released and transferred onto the releasing member.

For example, there is disclosed in Japanese Laid-open Patent Publication No. 1-297294 (1989), an apparatus as shown in FIG. 8. The apparatus is so arranged that a plane part of a belt form releasing member 201 is brought into pressure contact with a recording member 202, and the recording member 202 is moved in a curved state around a roller 203 to make separation, thereby the printing material on the recording member 202 is released and transferred onto the releasing member 201.

However, in the above apparatus, it has been observed that the recording member 202 passes through the roller 203 as it is adhered to the releasing member 201 without being curved at a separation beginning point where the recording member 202 starts to be curved. In the case when the length of the recording member 202 extends to the length of A4 size, it has been also observed that the recording member 202 is not uniformly curved, whereby some resin of the surface layer of the releasing member 201 is transferred to the recording member 202, and the printing material on the recording member 202 is not satisfactorily released onto the releasing member 201, leading to a bad deinking result.

In order to eliminate such disadvantages, a separation claw is generally used to separate the recording member from the releasing member. Since the conventional separation claw, however, comes into contact with the releasing member, there has been a drawback that the releasing member is damaged by the separation claw, or that the printing material is adhered to the separation claw and solidified thereon, causing a difficulty of cleaning after repeated operation.

There is also disclosed in Japanese Laid-open Patent Publication No. 7-175385 (1995), an apparatus for removing printing material, in which a separation beginning line between a releasing belt and a transfer paper is angled with respect to the front end edge of the transfer paper, the transfer paper is conveyed so that the front corner of the transfer paper reaches the curvature of the releasing belt first, whereby the transfer paper is easily separated from the releasing belt.

However, the apparatus described in the above publication has a construction with the transfer paper kept in a flat condition and the releasing member curved to remove the printing material. Therefore, compared to a construction with the transfer paper curved for the separation, it is inescapable that force for the separation becomes larger. Thus, it is essentially difficult to stably remove the printing material.

SUMMARY OF THE INVENTION

The present invention has been developed to substantially eliminate the above-described disadvantages.

It is therefore an object of the present invention to provide a printing material removing apparatus with which the printing material can be surely removed from the recording member.

In order to achieve the first object, there is provided an apparatus for removing printing material from a recording member on which an image is recorded by the printing material, comprising:

a releasing member having a plane surface with which the surface of the recording member recorded with the printing material comes into contact, the releasing member moving to a predetermined direction with the recording member held thereon; and a separating device disposed on the plane surface of the releasing member for separating the recording member from the releasing member, a separation line between the releasing member and the recording member being angled with respect to the front end of the recording member.

According to the apparatus for removing printing material, the front end of the side of the recording member is released first, whereby the separation of the recording member is easily and surely carried out at relatively small separation force.

Preferably, the angle of the separation line may be 5°–30°. The releasing member may be heated at the temperature of 80° C.–200° C. The releasing member may comprise a resin having a SP value of 8–12.

Preferably, the separating device may comprise: a separating roller angled with respect to the front end of the releasing member; and a roll-up roller provided at one end of the separating roller for pinching the front end of the recording member between the roll-up roller and the separating roller to remove the recording member from the releasing member.

In this case, the recording member is pinched by the roll-up roller and then the roll-up roller is pivoted around the separating roller, whereby the recording roller is surely separated from the releasing member.

Alternatively, the separating device may comprise: a separating roller angled with respect to the front end of the releasing member; and a chucking mechanism provided on the separating roller for chucking the front end of the recording member to remove the recording member from the releasing member.

In this case, the recording member is fixed by the chucking mechanism and then the separating roller is rotated, whereby the recording roller is surely separated from the releasing member.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

In each embodiment or variation, the same numerals are affixed to the elements having substantially same function and the detailed explanation thereof are omitted.

<First Embodiment>

Figure 1:
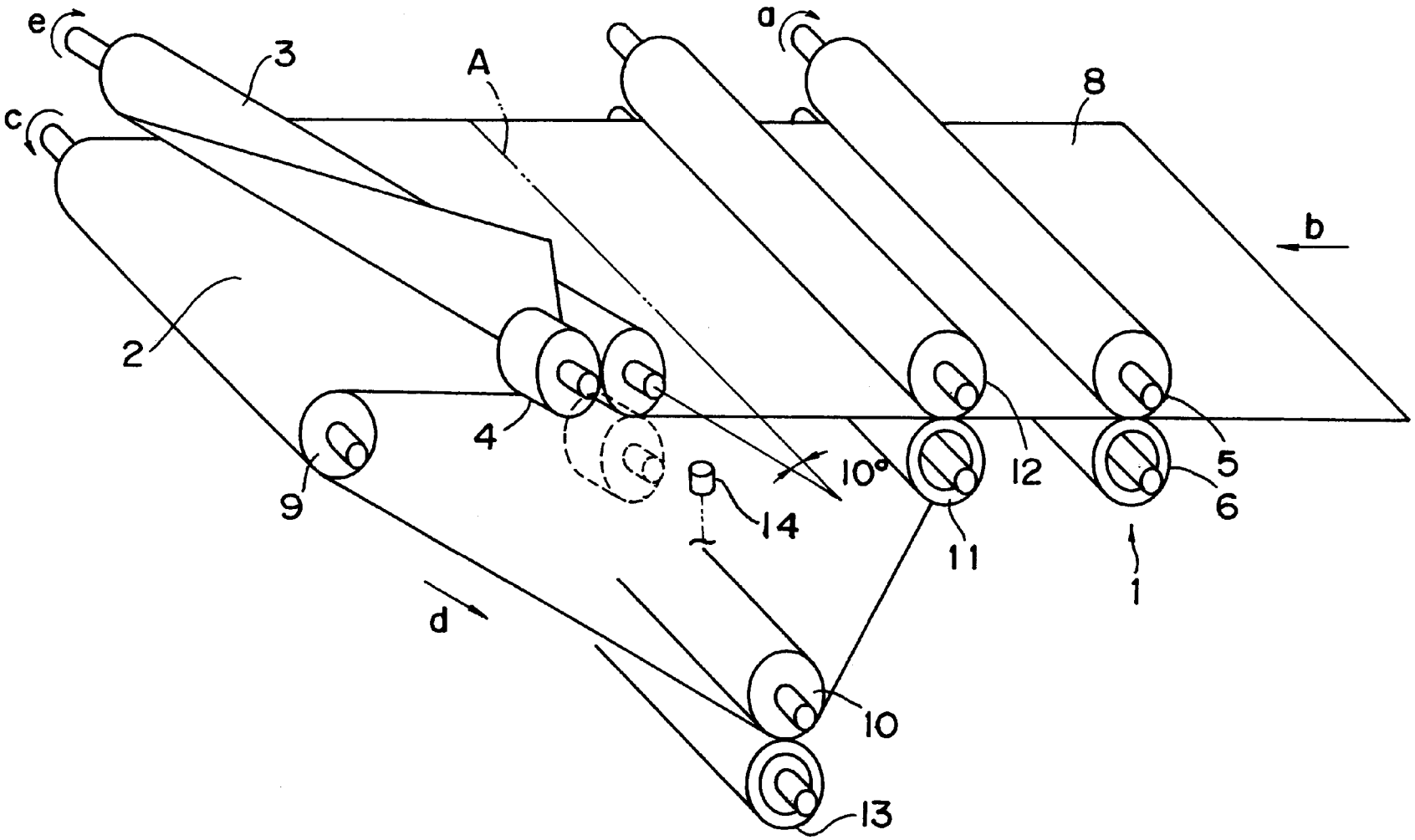
FIG. 1 is a view to show a first embodiment of the printing material removing apparatus of the present invention.

FIG. 1 shows a first embodiment of the printing material removing apparatus of the present invention. This apparatus comprises a paper feed roller 1, a releasing belt 2, a separating roller 3 and a roll-up roller 4.

Figure 2A:
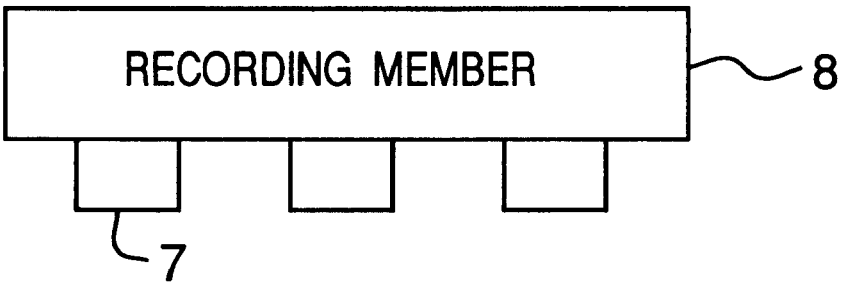
FIGS. 2A and 2B are schematic sectional views showing the constitution of the recording member and the releasing member.

The paper feed roller 1 comprises a driving roller 5 rotating in a direction of arrow "a" and a driven-cum-preheating roller 6 (hereinafter simply referred to as a preheating roller). The paper feed roller 1 can supply a recording member 8, on which printing material 7 is fixed to form a picture image as shown in FIG. 2A, in the state of the printing material 7 disposed below, horizontally toward the releasing belt 2 to be described later, in the direction of arrow "b". In the present embodiment, the recording member 8 is supplied so that the front end edge of the recording member 8 can be perpendicular to the conveying direction thereof.

The preheating roller 6 is to heat the printing material 7 of the recording member 8 to be supplied. The heating temperature is set at a level between 80° C. and 200° C. The reason is that if the temperature is under 80° C., the printing material 8 is not softened, and if over 200° C., the heat resistivity of the recording member 8 fails. Instead of co-using the heating roller 6 with the driven roller, there may be disposed on the downstream side of the paper feed roller 1 a far infrared heater, a silicon rubber heater or the like which heats the printing material 7 on the recording member 8 in a non-contact state.

The releasing belt 2 is borne on a driving roller 9, a driven roller 10 and the heating roller 11 which are disposed in triangle relations. The releasing belt 2 is movable in the direction of arrow "d" according to the rotation of the driving roller 9 in the direction of arrow "c". The width of the releasing belt 2 is set to be shorter than that of the recording member 8. The width can be decided on the basis of the length of the roll-up roller 4 as described hereinafter, for example, to an extent of 5–10 mm. Above the heating roller 11 there is disposed a backup roller 12 in a manner to be in pressure contact with the releasing belt 2 opposite to the heating roller 11. The heating roller 11 is to heat the later described releasing member surface layer 23 of the releasing belt 2 and also the printing material 7 of the supplied recording member 8. (Hereinafter, the opposed part between the heating roller 11 and the backup roller 12 is referred to as a pressure contact part.) The heating temperature by the heating roller 11 is set to be in the range between 80° C. and 200° C. in the same manner as the preheating roller 6.

Underneath the driven roller 10 of the releasing belt 2 there is disposed a heating roller 13 in a manner to be brought into pressure contact with the releasing belt 2 opposite to the driven roller 10. The heating roller 13 is to heat and melt the printing material 7 on the releasing belt 2 released from the recording member 8. In place of the heating roller 13, there may be provided a far infrared heater, a silicon rubber heater or the like for heating the printing material 7 on the releasing belt 2 in non-contact state. The heating temperature by the heating roller 13 is set to be in the range between 80° C. and 200° C. in the same manner as the preheating roller 6.

The process for preheating the recording member 8 or the releasing belt 2 may not be necessarily provided. Whether the preheating is executed or not can be decided taking various conditions such as velocity of printing material removing process, composition of toner or the like into consideration.

Hereinafter, the separating roller 3 and the roll-up roller 4 which are essential elements constituting the separating device for separating the recording member 2 from the releasing belt 2 in a curved state will be explained.

The separating roller 3 is disposed so that it can come into contact with the plane surface of the belt portion between the driving roller 9 and the heating roller 11 of the releasing belt 2. The separating roller 3 has an axis angled with respect to the front end edge "A" of the recording member 8 before being separated from the releasing belt 2. The angle of the axis of the separating roller 3 can be set to 5°–30°, preferably 5°–20°, more preferably 10°–12°. The separating roller 3 is to be driven to rotate in a direction of arrow "e" at the same speed as the releasing belt 2.

The roll-up roller 4 is disposed on one side of the releasing belt 2 in parallel to the axis of the separating roller 3 so that it can come into contact with the end of the separating roller 3 and pivot around the axis of the separating roller 3. (Hereinafter, the outlet side of the contact part between the roll-up roller 4 and the separating roller 3 is referred to as a separation part.) The roll-up roller 4 is to separate the recording member 8 from the releasing belt 2 and discharge it along the circumference of the separating roller 3 by pinching the front end of the recording member 8 entering between the roll-up roller 4 and the separating roller 3 and rolling up the recording member 8 along the outer surface of the separating roller 3. The upstream side of the contact part between the roll-up roller 4 and the separating roller 3 is provided with a sensor 14 for detecting the front end of the recording member 8 entering therebetween.

The recording member 8 to be treated by the printing material removing apparatus comprising the above constitution comprises a transparent plastic film (OHP sheet and the like) or a film (synthetic paper) which is made opaque by addition of inorganic fine particles. The recording member 8 is formed with an image of the printing material 7 thereon by an appropriate image forming apparatus such as electrophotographic copying machine, printer, facsimile or the like, as shown in FIG. 2A. The material of plastic film or film constituting synthetic paper is not specifically limited if it is a thermoplastic resin, but considering the heat resistance, the suitable ones are of polyester, polycarbonate, polyimide, polymethyl methacrylate, and the like. Of those, polyester, and especially polyethylene terephthalate is preferable in view of the universal applicability, price, heat resistance, durability, etc.

The printing material 7 which is recorded as an image in the recording member 8 is a so-called toner (hereinafter, the printing material is to be referred to as toner). The toner generally comprises acrylic (methacryl) polymer, acrylic (methacryl)-styrene copolymer, or polyester polymer as the main component, with addition of coloring agent, releasing agent, antistatic agent, etc. thereto.

Figure 2B:
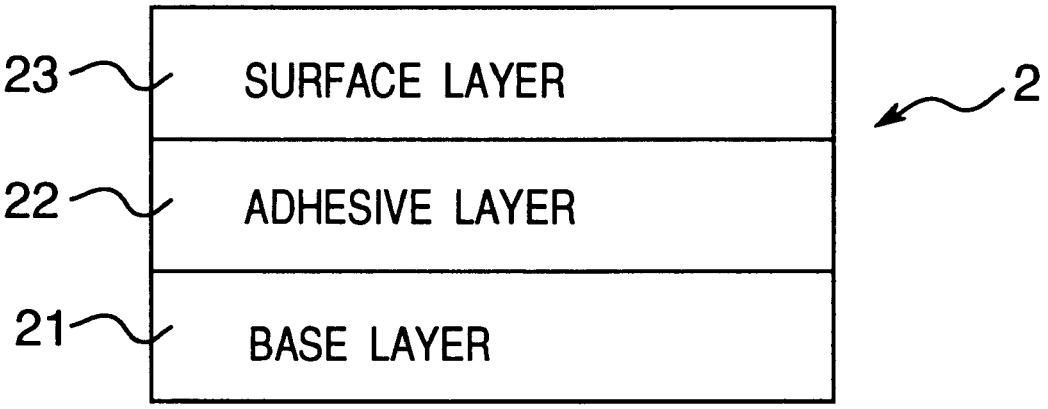

The releasing belt 2 comprises, as shown in FIG. 2B, a base layer 21, a adhesive layer 22 and a surface layer 23 provided on the base layer 21 through the adhesive layer 22.

The releasing member surface layer 23 is provided so as to release the toner 7 on the recording member 8. Namely, heat is applied to the toner 7 on the recording member 8 to soften the toner 7 and heat is also applied to the releasing member surface layer 23 to soften, then the toner 7 on the recording member 8 is caused to adhere to the releasing member surface layer 23. The lower limit of the temperature to be applied to the toner 7 is determined by the temperature at which the toner 7 is softened, and its upper limit is determined based on the heat resistance of the recording member 8. Substantially, the temperature to be applied to the toner is in the range between 80° C. and 200° C. Thus, by softening the toner 7 and also making the releasing member surface layer 23 softened state, adhesion of the toner 7 to the releasing member surface layer 23 is facilitated. For this reason, it is desirable that the releasing member surface layer 23 is thermoplastic resin having the softening point between 80° C. and 200° C. Especially, it is preferable that the softening point of the releasing member surface layer 23 is in the range of ±20° C. of the softening point of the toner. The softening point herein means the outflow starting temperature with the flow tester.

It is the essential conditions for the releasing member surface layer 23 to have good adhesive property to the toner 7. In other words, it is desirable for the material constituting the releasing member surface layer 23 to have high compatibility with the toner 7. In general, the compatibility between the different materials depends on the differences of the surface energies and SP values (solubility parameter). The materials whose SP values are close to each other show good compatibility. The SP value of the toner is variable by the kind of the resin which is the main component thereof, and it is approximately 9 to 11. The present inventors specially noted the SP value and made strenuous study of it. As a result, it has been found that when the SP value of the resin of the releasing member surface layer 23 is in the range between 8 and 12, the toner 7 on the recording member 8 is favorably transferred to the releasing member surface layer 23.

Examples of the resins having the softening points at 80–200° C., and SP value of 8–12 are polystyrene, styrene-acrylic (methacryl) copolymer, polyvinyl alcohol-vinyl acetate copolymer, polyvinyl acetal, polyester, and the like. Among these, styrene-acrylic (methacryl) copolymer, polyvinyl acetal, polyester resin, etc. are preferable from the viewpoint of the adhesion to toner, and the like.

On the other hand, the adhesive layer 22 is provided to cause the releasing member surface layer 23 to adhere to the base layer 21 and to prevent the transfer of the releasing member surface layer 23 to the recording member 8. With respect to the material to constitute the adhesive layer 22, the generally commercialized adhesives are given. Though the kinds of the adhesive are not particularly limited, there is required at least the adhesive having the heat resistance to a certain extent. examples of the adhesive materials are vinyl/methyl ether, maleic anhydride copolymer, polyvinyl alcohol/vinyl acetate copolymer, vinyl acetal, ethyl acrylate, polyamide resin, phenol resin, resorcinol resin, polyester resin, epoxy resin, furan resin, polyurethane resin, chlorinated rubber, butadiene, acrylonitrile rubber, butyl rubber, neoprene rubber, thiokol, and the like, though not limited to them.

The method for applying the adhesive to the base layer 21 includes the chemical reaction method, heat melt method, solvent evaporation method, etc. It is preferable to take a suitable method depending on the kind of the adhesive. The surface layer 23 of the releasing member 2 is not necessarily a resin. Any material that can adhere the heated printing material may be used such as metals of Al, Ni, etc. and rubbers, without being limited to resin.

Though, in the present embodiment, a multi-layer construction of the releasing belt is explained as a releasing member, a single layer constitution made of metal itself such as Al, Ni or the like, or resin itself as stated above can also be applied.

In order to remove the printing material 7 on the recording member 8 by the releasing belt 2, it is necessary that the adhesive strength between the recording member 8 and the printing material 7 is smaller than that between the releasing member surface layer 23 and the printing material 7. Thus, the releasing member surface layer 23 should be selected so that the critical surface tension of the releasing member surface layer 23 is higher than that of the recording member 8, or, in the case that the releasing member 23 has a resin surface, the critical surface tension of the resin surface is close to that of the printing material 7. Specifically, as the releasing member surface layer 23, metal such as Ni, Al, Fe or the like, metal oxide, and so on are given. In the case that the releasing member surface layer 23 is a resin, if PET is given as the releasing member surface layer 23, while the surface of the recording member 8 is coated with silicon resin or fluoroplastic, the printing material 7 can be surely removed. If polyester polymer used as printing material is given as the releasing member surface layer 23, while the surface of the recording member 8 is coated with surface active agent as charge prevent agent, the printing material 7 can be excellently removed. It is more preferable that the releasing member surface layer 23 comprises a material equivalent to the printing material 7 because a property that substances of same material are easily adhered to each other can be utilized.

Next, the operation of the printing material removing apparatus comprising the above constitution will be described below.

When the recording member 8 on which the image is formed by the toner 7 is supplied to the paper feed roller 1 under the condition of the toner 7 being positioned on the lower part. The toner 7 is preheated with the preheating roller 6 and molten. By this step, the aggregation forces between the toners 7 on the recording member 8 show increase. The recording member 8 with the toner 7 heated is transferred to the releasing belt 2 in the direction of arrow "b". When the recording member 8 with the toner 7 heated passes through the pressure contact part between the heating roller 11 and the backup roller 12, the recording member 8 is brought into pressure contact with the releasing member surface layer 23 heated by the heating roller 11. As a result, the toner 7 on the recording member 8 is fused with the releasing member surface layer 23. Thus the recording member 8 is further carried in the direction of arrow "b" under the condition of the toner 7 being fused with the releasing member surface layer 23. As the recording member 8 leaves the pressure contact part, the fused toner 7 and releasing member surface layer 23 are cooled and carried toward the separation part, while being solidified.

Figures 3A, 3B, 3C, 3D:
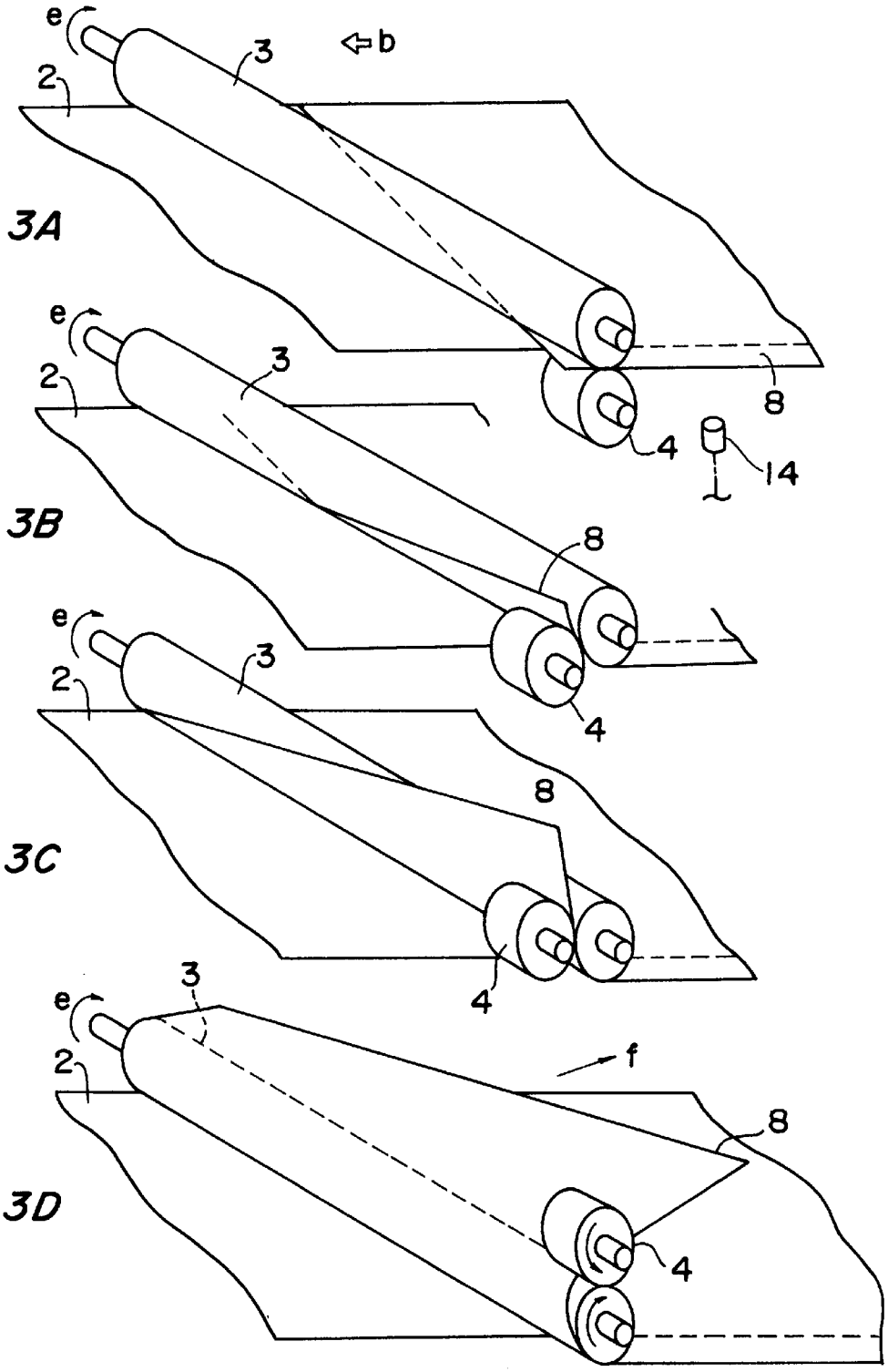
FIGS. 3A to 3D are views showing a state that a roll-up roller pivots to separate the recording member from the releasing member.

As the separating roller 3 is angled, the front end of the one side of the recording member 8 enters first between the separating roller 3 and the roll-up roller 4 as shown in FIG. 3A. Just before entering, the front end of the one side of the recording member 8 is detected by the sensor 14. After the predetermined time passes, the rollup roller 4 pivots around the axis of the separating roller 3 within an angle of 180°. FIGS. 3A to 3D illustrate an example of the roll-up roller 4 pivoting from a time point that the front end of the recording member is detected by the sensor 14 and enters into the opposite portion between separating roller 3 and the roll-up roller 4, until a time point that the recording member 8 partly passes through the opposite portion of the rollers. The recording member 8 is rolled up in a state that it is pinched between the separating roller 3 and the roll-up roller 4. The front end of the one side of the recording member 8 is surely separated first from the releasing belt 2, consequently all of the front end of the recording member 8 is separated from the releasing belt 2. The separation line of the recording member 8 is on the contact line between the separating roller 3 and the releasing belt 2 and is angled with respect to the front end of the recording member 8 before separating. The recording member 8 is curved by the separating roller 3 in the direction departing from the releasing member surface layer 23 and discharged along the circumference of the separating roller 3 in the direction of arrow "f". Though the pivot angle of the roll-up roller 4 is not limited to 180°, the roll-up roller 4 may be pivoted within an angle possible to separate the recording member 8.

As described above, in the embodiment, the roll-up roller 4 is pivoted around the separating roller 3, whereby the recording member 8 is pushed up from the side of its treating surface to be rolled up around the separating roller 3, allowing the recording member 8 to be surely separated from the releasing belt 2. The releasing member 2 and the recording member 8 are not damaged. At the time of separation, the recording member 8 is gradually tore off at the corner thereof first, reducing the separation force, improving both certainty and stability of the separation, and preventing the releasing belt 2 from being damaged due to the transfer of the releasing member surface layer 23 to the recording member 8.

The releasing member surface layer 23 and the recording member 8 are both required to be separated at the predetermined temperature, for example, lower than 80° C. According to inventor's investigation, if the toner 7 is separated from the recording member 8 at the temperature higher than 80° C., strong force is necessary to release it, making the releasing difficult. Thereby, even if there may be provided the adhesive layer 22 between the release member surface layer 23 and the base layer 21, the releasing member surface layer 23 may be peeled at the interface with the adhesive layer 22 due to the strong releasing force and then transferred to the recording member 8. Accordingly, it is desirable to provide around the separation part with a heat insulation wall in a manner to surround the separating belt 2, releasing roller 3 and roll-up roller 4 in order to maintain the separation part at a temperature lower than 80° C.

The toner 7 on the recording member 8 remains on the releasing member surface layer 23 in molten and solidified state by being released from the recording member 8 and transferred to the releasing member surface layer 23. Here, because, as described above, the toner 7 is heated in advance by the preheating roller 6 to have increased aggregation force, it is securely released without showing discontinuance in the course of the release from the recording member 8 to the releasing member surface layer 23. The toner 7 transferred to the releasing member surface layer 23 moves in the direction of arrow "d" along with the releasing belt 2. When the toner 7 on the releasing member surface layer 23 reaches the opposite part to the heating roller 13, the toner 7 is heated by the heating roller 13. As a result, the aggregation force between the toners 7 becomes stronger and the adhesive force between the toner 7 and the releasing member surface layer 23 increases, preventing re-transfer to a recording member 8 to be supplied next.

Figure 4:
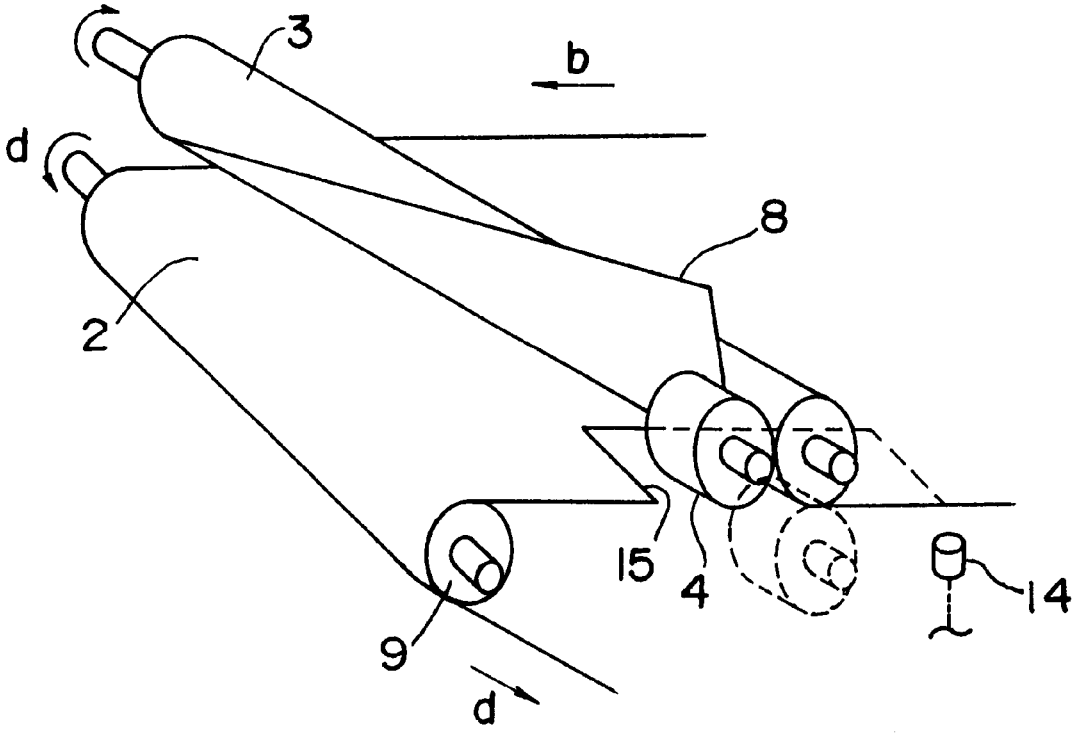
FIG. 4 is a view showing a variation of the first embodiment of FIG. 1.

Although the width of the releasing belt 2 in the first embodiment is shorter than that of the recording member 8, it may be identical to that of the recording member 8 as shown in FIG. 4. In this case, the roll-up roller 4 comes into contact with the separating roller 3 via the releasing belt 2. The releasing belt 2 is provided with a cutout portion 15 at the one side thereof. Thus, the recording member 8 is supplied so that the front end of the recording member 8 coincides with the cutout portion 15. When the cutout portion 15 is detected by the sensor 14 and comes to the contact part between the separating portion 3 and the roll-up roller 4, the roll-up roller 4 can be pivoted. In this arrangement, all surface of the recording member 8 comes into contact with the releasing member 2. Thus, even if an image is recorded on both side edge portions of the recording member 8 with the printing material 7, the printing material 7 can be substantially perfectly removed from the recording member 8 except its front end corner portion.

<Second Embodiment>

Figure 5:
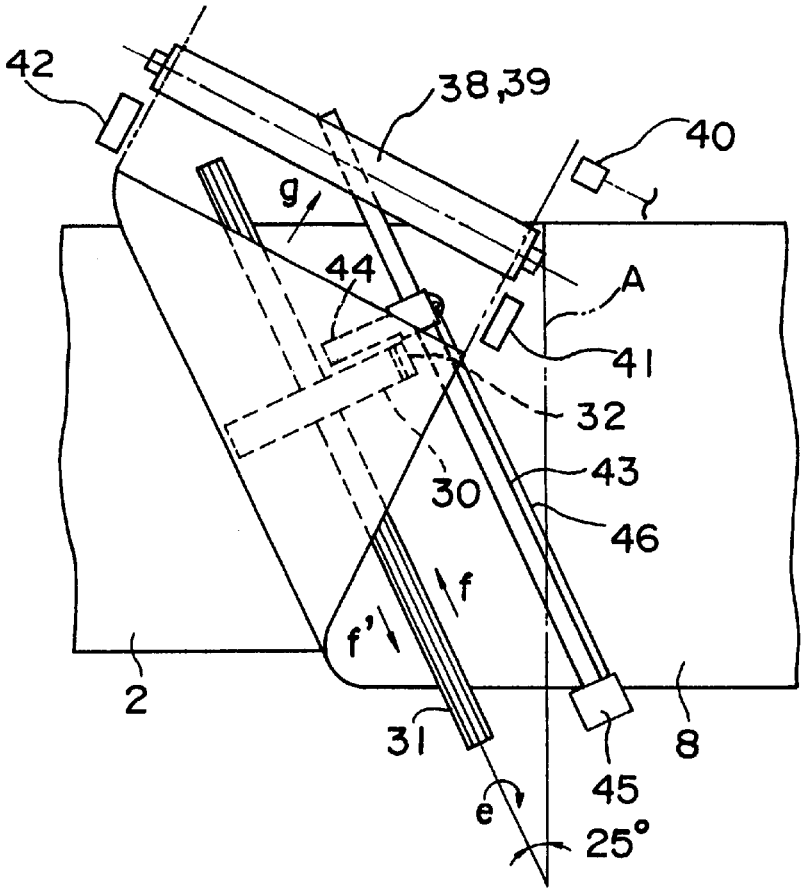
FIG. 5 is a view to show a second embodiment of the printing material removing apparatus of the present invention.

FIG. 5 shows a second embodiment of the printing material removing apparatus of the present invention. In this embodiment, a separating roller 30 having larger diameter and shorter width than the separating roller of the aforementioned first embodiment is provided. The separating roller 30 is angled with respect to the front end edge "A" of the recording member 8 before separating. In this embodiment, the angle is 25°. The separating roller 30 has a spline mechanism in which the separating roller 30 is possible to rotate with its shaft 31 and also slide in the axial direction of the shaft 31.

Figure 6:
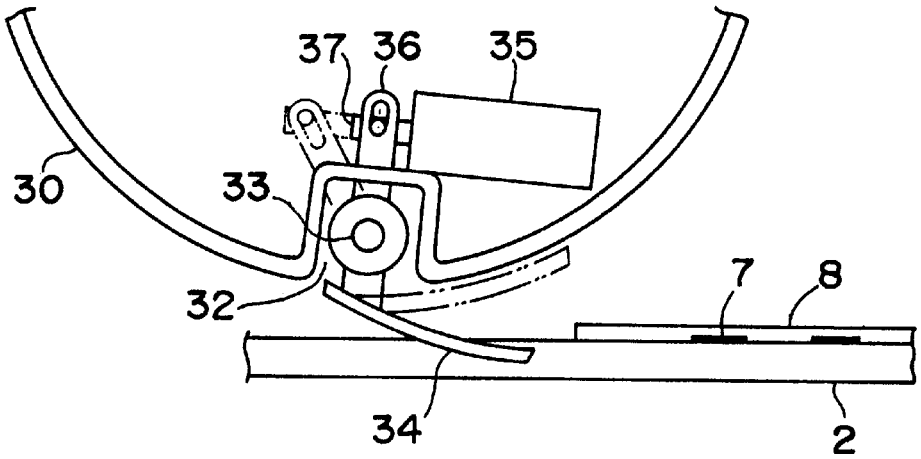
FIG. 6 is an enlarged view of a chuck of the separating roller.

On the outer surface of the separating roller 30 as shown in FIG. 6 is formed a recess 32 extending in the axial direction of the separating roller 30. In this recess 32 is supported a wing-like chuck 34 rotatable around a shaft 33 disposed in parallel to the axis of the separating roller 30. Inside the separating roller 30 is fixed a solenoid 35. The shaft 33 of the chuck 34 is provided with a lever 36 projecting toward the inside of the separating roller 30. The lever 36 is connected to a plunger 37 of the solenoid 35. Thus, the chuck 34 is possible to move between an open position that the extremity of the chuck 34 departs from the outer surface of the separating roller 30 and a close position that the extremity of the chuck 34 comes into contact with the outer surface of the separating roller 30.

In the second embodiment, the separating roller 30, the shaft 31 and the chuck 34 are main elements to constitute the separating device for separating the recording member 8 from the releasing belt 2.

Above the releasing belt 2 and downstream in the discharge direction of arrow "g" as shown in FIG. 5 with respect to the separating roller 30, there is disposed a pair of discharge rollers 38, 39 each having an axis in a direction perpendicular to the discharge direction "g" of the recording member 8. The pair of discharge rollers 38, 39 is disposed close to a position that the recording member 8 is released from the chuck 32, but so as not to obstruct the movement of the separating roller 30. Downstream the discharge rollers 38, 39 is disposed a sensor 40 for detecting the rear end of the recording member 8. It is preferable to provide guide members 41, 42 for guiding the movement of the recording member 8 on both side of the discharge direction "g" of the recording member 8.

A rail 43 is provided in parallel to the shaft 31 of the separating roller 30. On the rail 43 is slidably mounted a slider 44 that comes into contact with the side surface of the separating roller 30. At the end of the rail 43 is provided a reel 45 for winding a string one end of which is connected to the slider 44.

Figure 7A:
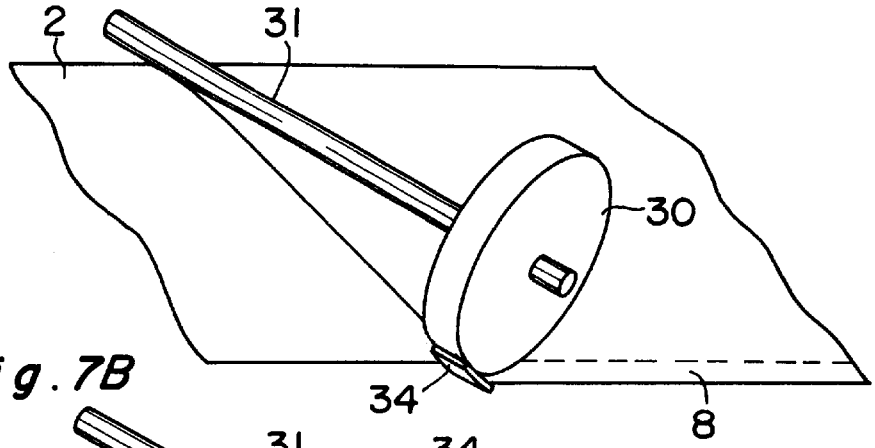
FIGS. 7A to 7C are views to show a state that the recording member is separated from the recording member by the chuck and the separating roller.
Figure 7B:
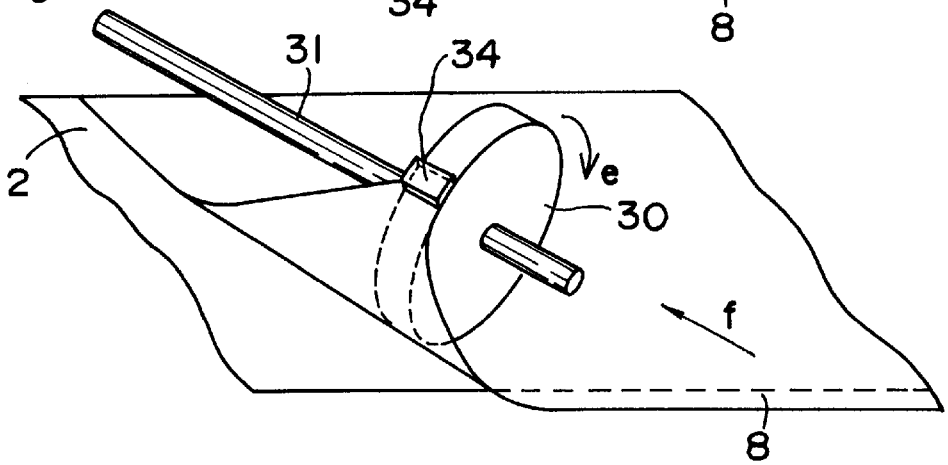

In the second embodiment of the printing material removing apparatus comprising the above constitution, when the front end of the one side of the recording member 8 reaches the chuck 34 of the separating roller 30 and enters between the chuck 34 and the separating roller 30 as shown in FIG. 7A, the chuck 34 is operated to move to the close position to fix the front end of the recording member 8. Immediately, the separating roller 30 is rotated in the direction of arrow "e". Thus, the recording member 8 is wound around the separating roller 30 in a state that the front end thereof is fix by the chuck 34. As a result, the recording member 8 is curved at a constant curvature in a direction departing from the releasing member surface layer 23 of the releasing belt 2, thereby the recording member 8 is surely released from the releasing belt 2. The separating roller 30 moves along its shaft 31 in the direction of arrow "f" as it rotates, whereby the slider 44 is pushed by the separating roller 30 to slide on the rail 43.

Figure 7C:
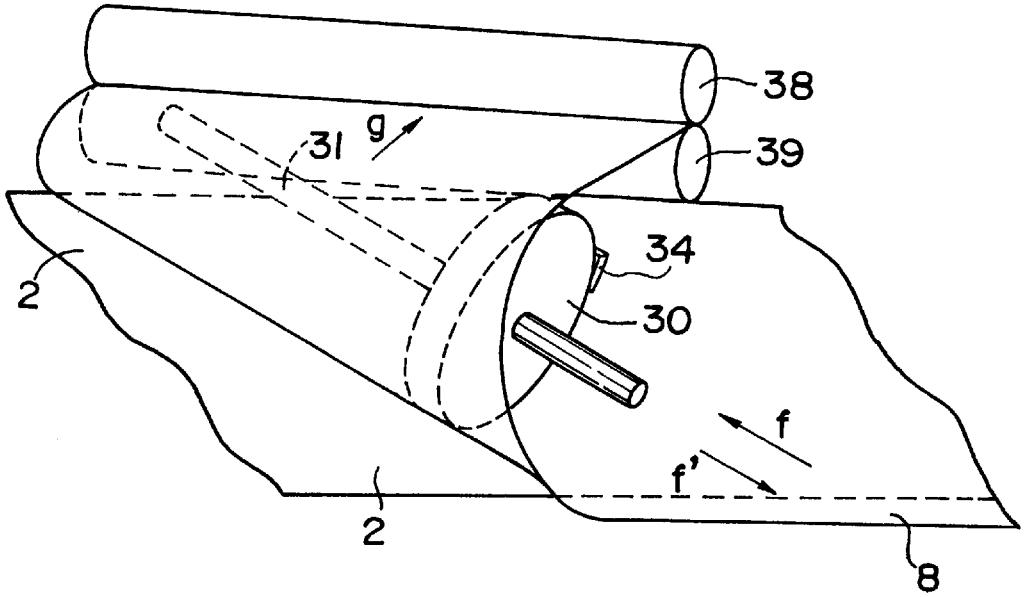
Figure 8:
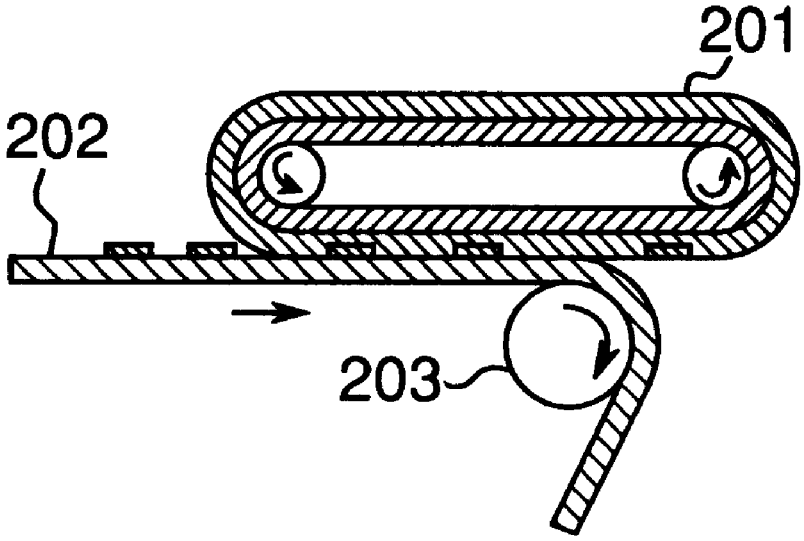
Fig.8 PRIOR ART
FIG. 8 is a view to show a printing material moving apparatus of the prior art.

Then, at the time that the separating roller 30 rotates substantially 180°, the chuck 34 is operated to move to the open position to release the front end of the recording member 8 as shown in FIG. 7C. As a result, the recording member 8 moves in the direction of arrow "g" without being wound around the separating roller 30 and discharged through the discharge rollers 38, 39. Once the front end of the recording member 8 is released from the chuck 34, the chuck 34 is operated to return to the close position again. When the rear end of the recording member is detected by the sensor 40 as shown in FIG. 5 and the discharge of the recording member 8 is finished, the reel 45 is rotated to rewind the string 46 while rotating the shaft 31 in a reverse direction to the direction of arrow "e", whereby the separating roller 30 is moved in the direction of arrow "f" and returned to the original position as shown in FIG. 7A. The chuck 34 is operated to move to the open position and stands to the arrival of the next recording member 8.

As described above, providing the shaft 31 angled with respect to the front end of the recording member 8, the separating roller 30 moveable along the shaft 31, and the chuck 34 provided on the separating roller enables the recording member 8 to be surely separated from the releasing member without using the roll-up roller 4 as in the first embodiment.

Although the present invention has been fully described by way of the examples with reference to the accompanying drawing, it is to be noted that here that various changes and modifications will be apparent to those skilled in the art. Therefore, unless such changes and modifications otherwise depart from the spirit and scope of the present invention, they should be construed as being included therein.

What is claimed is:

1. An apparatus for removing printing material from a recording member on which an image is recorded by the printing material, comprising:

a releasing member having a plane surface with which the surface of the recording member recorded with the printing material comes into contact, the releasing member moving in a predetermined direction with the recording member held thereon; and a separating device disposed on the plane surface of the releasing member for separating the recording member from the releasing member along a whole width of the recording member, a separation line between the releasing member and the recording member being angled with respect to a front end of the recording member.

2. An apparatus for removing printing material according to claim 1, wherein the angle of an separation line is 5°–30°.

3. An apparatus for removing printing material according to claim 1, wherein the releasing member is heated at a temperature of 80° C.–200° C.

4. An apparatus for removing printing material according to claim 1, wherein the releasing member comprises a resin having an SP value of 8–12.

5. An apparatus for removing printing material according to claim 1, wherein the separating device comprises:

a separating roller angled with respect to the front end of the releasing member; and a roll-up roller provided at one end of the separating roller for pinching the front end of the recording member between the roll-up roller and the separating roller to remove the recording member from the releasing member.

6. An apparatus for removing printing material according to claim 1, wherein the separating device comprises:

a separating roller angled with respect to the front end of the releasing member; and a chucking mechanism provided on the separating roller for chucking the front end of the recording member to remove the recording member from the releasing member.

7. An apparatus for removing printing material from a recording member on which an image is recorded by the printing material, comprising:

a releasing member having a plane surface with which a surface of the recording member recorded with the printing material comes into contact, the releasing member moving in a predetermined direction with the recording member held thereon; and a separating device disposed on the plane surface of the releasing member for separating the recording member from the releasing member, a separation line between the releasing member and the recording member being angled with respect to a front end of the recording member, the separating device comprising a separating roller angled with respect to the front end of the releasing member and a roll-up roller provided at one end of the separating roller for pinching the front end of the recording member between the roll-up roller and the separating roller to remove the recording member from the releasing member.

8. An apparatus for removing printing material according to claim 7, wherein an angle of the separation line is 5°–30°.

9. An apparatus for removing printing material according to claim 7, wherein the releasing member is heated at a temperature of 80° C.–200° C.

10. An apparatus for removing printing material according to claim 7, wherein the releasing member comprises a resin having an SP value of 8–12.

11. An apparatus for removing printing material from a recording member on which an image is recorded by the printing material, comprising:

a releasing member having a plane surface with which a surface of the recording member recorded with the printing material comes into contact, the releasing member moving in a predetermined direction with the recording member held thereon; and a separating device disposed on the plane surface of the releasing member for separating the recording member from the releasing member, a separation line between the releasing member and the recording member being angled with respect to a front end of the recording member, the separating device comprising a separating roller angled with respect to the front end of the releasing member and a chucking mechanism provided on the separating roller for chucking the front end of the recording member to remove the recording member from the releasing member.

12. An apparatus for removing printing material according to claim 11, wherein an angle of the separation line is 5°–30°.

13. An apparatus for removing printing material according to claim 11, wherein the releasing member is heated at a temperature of 80° C.–200° C.

14. An apparatus for removing printing material according to claim 11, wherein the releasing member comprises a resin having an SP value of 8–12.

15. An apparatus for removing printing material from a recording member on which an image is recorded by the printing material, comprising:

a releasing member having a plane surface with which a surface of the recording member recorded with the printing material comes into contact, the releasing member moving in a predetermined direction with the recording member held thereon; and a separating device disposed on the plane surface of the releasing member for separating the recording member from the releasing member, a separation line between the releasing member and the recording member being angled with respect to a front end of the recording member, an angle of the separation line being 5°–30°.

16. An apparatus for removing printing material from a recording member on which an image is recorded by the printing material, comprising:

a releasing member having a plane surface with which the surface of a recording member recorded with the printing material comes into contact, the releasing member moving in a predetermined direction with the recording member held thereon; and a separating device disposed on the plane surface of the releasing member for separating the recording member from the releasing member, a separation line between the releasing member and the recording member being angled with respect to the front end of the recording member, wherein the releasing member comprises a resin having an SP value of 8–12.

* * * * *

UNITED STATES PATENT AND TRADEMARK OFFICE

CERTIFICATE OF CORRECTION

PATENT NO. : 6,115,579
DATED : September 5, 2000
INVENTOR(S) : Kazuko Taniguchi and Haruhiko Atarashi It is certified that error appears in the above-identified patent and that said Letters Patent is hereby corrected as shown below:

Column 7,
Line 52, delete "separating belt 2", and insert -- separating roller 3 --.
Line 53, delete "releasing roller 3", and insert -- releasing belt 2 --.

Column 10, claim 2,
Line 6, after "wherein", delete "the", and insert -- an --.
Line 6, before "separation", delete "an", and insert -- the --.

Column 10, claim 3,
Line 9, delete the first instance of "C.", and insert -- C --.

Column 10, claim 9,
Line 54, delete the first instance of "C.", and insert -- C --.

Column 11, claim 13,
Line 15, delete the first instance of "C.", and insert -- C --.

Column 12, claim 16,
Line 12, after "which", delete "the", and insert -- a --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*